US011546975B2

(12) United States Patent
Rogan et al.

(10) Patent No.: US 11,546,975 B2
(45) Date of Patent: Jan. 3, 2023

(54) INDUCTION HEATABLE CARTRIDGE FOR A VAPOUR GENERATING DEVICE

(71) Applicant: JT International S.A., Geneva (CH)

(72) Inventors: Andrew Robert John Rogan, Forres (GB); Mark Gill, London (GB)

(73) Assignee: JT International SA

( * ) Notice: Subject to any disclaimer, the term of this patent is extended or adjusted under 35 U.S.C. 154(b) by 332 days.

(21) Appl. No.: 16/648,093

(22) PCT Filed: Sep. 21, 2018

(86) PCT No.: PCT/EP2018/075706
§ 371 (c)(1),
(2) Date: Mar. 17, 2020

(87) PCT Pub. No.: WO2019/057942
PCT Pub. Date: Mar. 28, 2019

(65) Prior Publication Data

US 2020/0275705 A1 Sep. 3, 2020

(30) Foreign Application Priority Data

Sep. 22, 2017 (EP) ..... 17192584

(51) Int. Cl.
*A24F 13/00* (2006.01)
*H05B 6/10* (2006.01)
(Continued)

(52) U.S. Cl.
CPC ..... *H05B 6/105* (2013.01); *A24F 40/42* (2020.01); *A24F 40/465* (2020.01); *A24F 40/57* (2020.01); *H05B 6/40* (2013.01); *A24F 40/20* (2020.01)

(58) Field of Classification Search
CPC ..... A24F 47/00
(Continued)

(56) References Cited

U.S. PATENT DOCUMENTS

2011/0248024 A1 10/2011 Yonenaga et al.
2017/0055575 A1 3/2017 Wilke et al.
(Continued)

FOREIGN PATENT DOCUMENTS

CN 102017078 A 4/2011
CN 106455713 A 2/2017
(Continued)

OTHER PUBLICATIONS

International Search Report including the Written Opinion from Application No. PCT/EP2018/075706 dated Dec. 14, 2018, 13 pages.
Search Report dated Jun. 26, 2021 from Office Action for Chinese Application No. 201880061230.5 dated Jul. 5, 2021. 3 pgs.
(Continued)

*Primary Examiner* — Phuong K Dinh
(74) *Attorney, Agent, or Firm* — Lerner, David, Littenberg, Krumholz & Mentlik, LLP

(57) ABSTRACT

An induction heatable cartridge for use with an induction heating assembly includes a solid vaporisable substance and at least one ring-shaped induction heatable susceptor held within and surrounded by the vaporisable substance. The susceptors are held in position such that, when the cartridge is positioned in an induction circuit in use, different regions of the outer edge of the one or more susceptors are at different distances from the induction circuit to provide different heating characteristics in the different regions. The centres of each of the at least one susceptors are aligned along a common axis.

16 Claims, 5 Drawing Sheets

(51) Int. Cl.

| | |
|---|---|
| ***A24F 40/465*** | (2020.01) |
| ***A24F 40/57*** | (2020.01) |
| ***A24F 40/42*** | (2020.01) |
| ***H05B 6/40*** | (2006.01) |
| *A24F 40/20* | (2020.01) |

(58) Field of Classification Search
USPC ..... 131/328–329
See application file for complete search history.

(56) References Cited

U.S. PATENT DOCUMENTS

| | | | | |
|---|---|---|---|---|
| 2017/0055585 | A1 | 3/2017 | Fursa et al. | |
| 2017/0079330 | A1 | 3/2017 | Mironov et al. | |
| 2017/0156403 | A1 | 6/2017 | Gill et al. | |
| 2020/0236998 | A1* | 7/2020 | Batista ..... | H05B 6/108 |

FOREIGN PATENT DOCUMENTS

| | | | |
|---|---|---|---|
| JP | 2017526381 | A | 9/2017 |
| TW | 201545674 | A | 12/2015 |
| WO | 2015198015 | A1 | 12/2015 |
| WO | 2017001818 | A1 | 1/2017 |
| WO | 2017029268 | A1 | 2/2017 |
| WO | 2017036958 | A2 | 3/2017 |
| WO | 2017036959 | A1 | 3/2017 |
| WO | 2017068094 | A1 | 4/2017 |
| WO | 2017068098 | A1 | 4/2017 |
| WO | 2017068100 | A1 | 4/2017 |
| WO | 2017068101 | A1 | 4/2017 |
| WO | 2017085242 | A1 | 5/2017 |

OTHER PUBLICATIONS

Search Report dated Jun. 23, 2022 from the Office Action for Taiwanese Application No. 107132738, 1 page.

* cited by examiner

INDUCTION HEATABLE CARTRIDGE FOR A VAPOUR GENERATING DEVICE

CROSS-REFERENCE TO RELATED APPLICATIONS

The present application is a national phase entry under 35 U.S.C. § 371 of International Application No. PCT/EP2018/075706, filed Sep. 21, 2018, published in English, which claims priority to European Application No. 17192584.5 filed Sep. 22, 2017, the disclosures of which are incorporated herein by reference.

BACKGROUND OF THE INVENTION

The present invention relates to an induction heatable cartridge for a vapour generating device. Devices which heat, rather than burn, a substance to produce a vapour for inhalation have become popular with consumers in recent years.

Such devices can use one of a number of different approaches to provide heat to the substance. One such approach is a vapour generating device which employs an inductive heating system. In such a device an induction coil (hereinafter also referred to as an inductor) is provided with the device and a susceptor is provided with the vapour generation substance. Electrical energy is provided to the inductor when a user activates the device which in turn creates an electromagnetic field. The susceptor couples with the field and generates heat which is transferred to the substance and vapour is created as the substance is heated.

Such an approach has the potential to provide better control of heating and therefore vapour generation. However, in practice, such an approach often requires a single inductor generating a common electromagnetic field. This can make it difficult to precisely generate a desired heat profile in the region of the susceptor and as a result, it is not easily possible to fully control the generation of vapour.

With a growing demand for users to be able to produce a variety of vapour from such devices, a device which provides precise control of the heat profile within the vaporisable substance and which is lightweight and compact, is desirable.

The present invention seeks to mitigate at least some of the above problems.

SUMMARY OF INVENTION

According to a first aspect of the present invention, there is provided an induction heatable cartridge for use with an induction heating assembly, the cartridge comprising: a solid vaporisable substance; and at least two ring-shaped induction heatable susceptors held within and surrounded by the vaporisable substance, the at least two susceptors held in position such that, when the cartridge is positioned in an induction circuit in use, different regions of an edge portion or portions of each susceptor are at different distances from the induction circuit to provide different heating characteristics in the different regions and such that the centres of each of the two or more susceptors are aligned along a common axis.

According to another aspect of the present invention, there is provided an induction heatable cartridge arranged, in use, to be inserted to a chamber of an induction heating assembly, the chamber being at least partially surrounded by an induction circuit, the cartridge comprising: a solid vaporisable substance; and at least two ring-shaped induction heatable susceptors held within and surrounded by the vaporisable substance, the at least two susceptors held in position such that, when the cartridge is at least partially surrounded by the induction circuit in use, different regions of the edges of the two or more susceptors are at different distances from the induction circuit to provide different heating characteristics in the different regions, and wherein the centres of each of the at least two susceptors are aligned along a common axis.

In accordance with either aspect, the way in which heat supplied by the susceptors varies within a cartridge may be termed the heat profile within the cartridge. By having different regions of an edge portion or portions of the one or more ring-shaped susceptors arranged at different distances from the induction circuit, it is possible to provide in use the ability to control the heat profile within the cartridge to deliver a desired heating to specific regions of the vaporisable substance.

The edge portion or portions of the ring shaped susceptors may include an outer edge and an inner edge. Typically, the outer edge of each susceptor may be outwardly oriented. By this we intend to mean that the outwardly oriented edge is generally facing away from a centre of the susceptor and forms the outer periphery of the ring-shaped susceptor. However, the or each inner edge of each susceptor may be inwardly oriented. By this we intend to mean that the inwardly oriented edge is generally facing towards a centre of the susceptor and forms the periphery of the hole in the ring-shaped susceptor.

The outer (or inner) perimeter of the ring-shaped susceptors may be of any shape. For example, the outer perimeter of the ring-shaped susceptors may be substantially circular. Alternatively, the outer perimeter may be oval, convex-concave, wave-like or square. Alternatively, the outer perimeter may be a random shape. The inner perimeter of the ring-shaped susceptors may also be of any shape, and may take the shape of any of the above examples.

The susceptors may comprise one or more of, but not limited to, aluminium, iron, nickel, stainless steel and alloys thereof (e.g. Nickel Chromium). With the application of an electromagnetic field in its vicinity, the susceptor may generate heat due to eddy currents and magnetic hysteresis losses resulting in a conversion of energy from electromagnetic to heat.

The vaporisable substance may be any type of solid or semi-solid material. Example types of vapour generating solids include powder, granules, pellets, shreds, strands, porous material or sheets. The substance may comprise plant derived material and in particular, the substance may comprise tobacco.

Preferably, the vaporisable substance may comprise an aerosol-former. Examples of aerosol-formers include polyhyrdric alcohols and mixtures thereof such as glycerine or propylene glycol. Typically, the vaporisable substance may comprise an aerosol-former content of between approximately 5% and approximately 50% on a dry weight basis. Preferably, the vaporisable substance may comprise an aerosol-former content of approximately 15% on a dry weight basis.

Upon heating, the vaporisable substance may release volatile compounds. The volatile compounds may include nicotine or flavour compounds such as tobacco flavouring.

The cartridge may comprise any number of two or more susceptors. The cartridge may be arranged such that the edges of each of the at least two susceptors are at different distances from the induction circuit when the cartridge is positioned in the induction circuit in use to provide the different regions.

The use of two or more susceptors with edges at different distances from the induction circuit provides in use a variation in the heat profile between the at least two susceptors.

Whilst there may be some advantages to having susceptors all with the same shape and size (for example, ease of manufacture and cost reduction), preferably, each of the at least two susceptors may have a different shape and size. In the case that the susceptors are substantially circular, the susceptors may have different diameters, or have holes with different diameters.

The use of susceptors of different diameters enables the simple provision of susceptors with their outer edges at different distances from the induction circuit, while maintaining radial symmetry within the cartridge.

The common axis linking the centres of each of the susceptors may be oriented in any direction. For example, the common axis may be arranged substantially diagonally, such that each ring-shaped susceptor is inclined at an angle relative to the longitudinal axis of the cartridge. Preferably, the common axis may be a longitudinal axis of the cartridge. This allows the susceptors to be biased towards one side of the induction circuit to provide a variation in the distances of different regions of the outer edges, while ensuring that the vaporisable substance is symmetrically distributed through each axial cross-section of the cartridge.

Alternatively, the longitudinal axis may be a central longitudinal axis. This allows the cartridge to maintain radial symmetry throughout the longitudinal length of cartridge.

The cartridge may be placed near to, or within, an external induction circuit in order to heat the susceptors and thereby vaporise the vaporisable substance. Although the susceptors may be arranged in any configuration with respect to the induction circuit, typically, the common axis of the susceptors may be arranged such that when the cartridge is placed within an induction circuit in use, it is parallel with an axis of the induction circuit.

By arranging the common axis parallel to the axis of the induction circuit, it is possible to minimise the loss of power from the external electromagnetic field through any orthogonal components of the coupling. This improved coupling leads to a stronger and more reliable heating effect to the susceptors and therefore to the vaporisable substance.

The diameter, position and orientation of each susceptor may be chosen according to a set of rules in order to create a pattern. For example, the susceptors may be arranged such that the diameter of each susceptor and/or the diameter of the hole on each susceptor is smaller than its predecessor in a given direction to provide an array of susceptors of progressively smaller diameter in the given direction and/or susceptors having holes with progressively smaller holes in the given direction.

The ability to control the heat profile within the cartridge enables different regions of the cartridge to be at different temperatures. The cartridge may contain multiple types of vaporisable substance, such that different solid vaporisable substances are positioned around each of the at least two different regions. For example, a first vaporisable substance may release vapour at a first predetermined temperature and a second vaporisable substance may release vapour at a second temperature higher than the first temperature. The different types of vaporisable material may be positioned at specific regions of the cartridge with differing heat profiles such that the vaporisation of each material is optimised.

Although the cartridge may comprise any vaporisable substance, preferably the solid material may comprise tobacco.

The induction heatable cartridge may comprise an air permeable material in the form of a shell or membrane which holds the vaporisable substance and susceptors. The air permeable material may be a material which is electrically insulating and non-magnetic. The material may have a high air permeability to allow air to flow through the material with a resistance to high temperatures. Examples of suitable air permeable materials include cellulose fibres, paper, cotton and silk. The air permeable material may also act as a filter. Alternatively, the vaporisable substance and susceptors may be held inside a material that is not air permeable, but which comprises appropriate perforation or openings to allow air flow.

According to another aspect of the present invention, there is provided a vapour generating device comprising: an induction heatable cartridge according to the first aspect; and an induction heating circuit arranged to generate, in use, an electromagnetic field which couples with the cartridge to create heat therein.

By using an induction heatable cartridge employing susceptors optimised for generating a desired heat profile within the cartridge, it is possible to provide an efficient vapour generating device capable of producing a vapour from multiple vaporisable substances.

Typically, the induction circuit may be in the form of a cylindrical coil. Whilst the induction coil may comprise any suitable material, typically the induction coil comprises a Litz wire or a Litz cable.

Alternatively, the induction circuit may be in the form of a coil of irregular shape such that it has components which are at different distances from the one or more susceptors in the cartridge to provide different heating characteristics in the different regions of the cartridge.

The use of an irregularly shaped coil allows the provision of different distances between the edges of the susceptors and the induction circuit, even with regularly shaped susceptors. For example, the diameter of the coil may vary along its longitudinal axis. The variation in diameter of the coil may be continuous or non-continuous along the longitudinal axis. In such a case, the circuit may have components which are at different lateral distances from the one or more susceptors in the cartridge.

The device may be arranged to operate in use with a fluctuating electromagnetic field having a magnetic flux density of between approximately 0.5 T and approximately 2 T at the point of highest concentration.

The device and circuitry may be configured to operate at a high frequency. Typically, the device and circuitry may be configured to operate at a frequency of between approximately 80 kHz and 500 kHz, preferably between approximately 150 kHz and approximately 250 kHz, more preferably 200 kHz.

Although the induction circuit may take any form, preferably the induction circuit may have a form in which its internal diameter progressively decreases from one side to the other in its axial direction.

According to another aspect of the present invention, there is provided a vapour generating device comprising: an induction heatable cartridge; and an induction heating circuit arranged to generate, in use, an electromagnetic field which couples with the cartridge to create heat therein; wherein the induction circuit is in the form of a coil of irregular shape such that it has components which are at different distances from one or more susceptors in the cartridge to provide different heating characteristics in the different regions of the cartridge.

By having an induction circuit in the form of an irregularly shaped coil, it is possible to provide a vapour generating device capable of producing a complex heat profile within a regularly or irregularly shaped induction heatable cartridge. For example, the diameter of the coil may vary along its longitudinal axis. The variation in diameters of the coil may be continuous or non-continuous. In such a case, the circuit may have components which are at different lateral distances from the one or more susceptors in the cartridge.

Although the susceptor may take any form, preferably the susceptor may take a ring-shaped form.

Although the induction circuit may take any form, preferably the induction circuit may have a form in which its internal diameter progressively decreases from one side to the other in its axial direction.

BRIEF DESCRIPTION OF FIGURES

An example induction heating assembly and example induction heatable cartridges are described in detail below, with reference to the accompanying figures in which.

DETAILED DESCRIPTION

The present invention provides a vapour generating device employing an inductive heating system and a cartridge comprising induction heatable susceptors which provide the ability to generate in use a desired heat profile within the cartridge.

Figure 1:
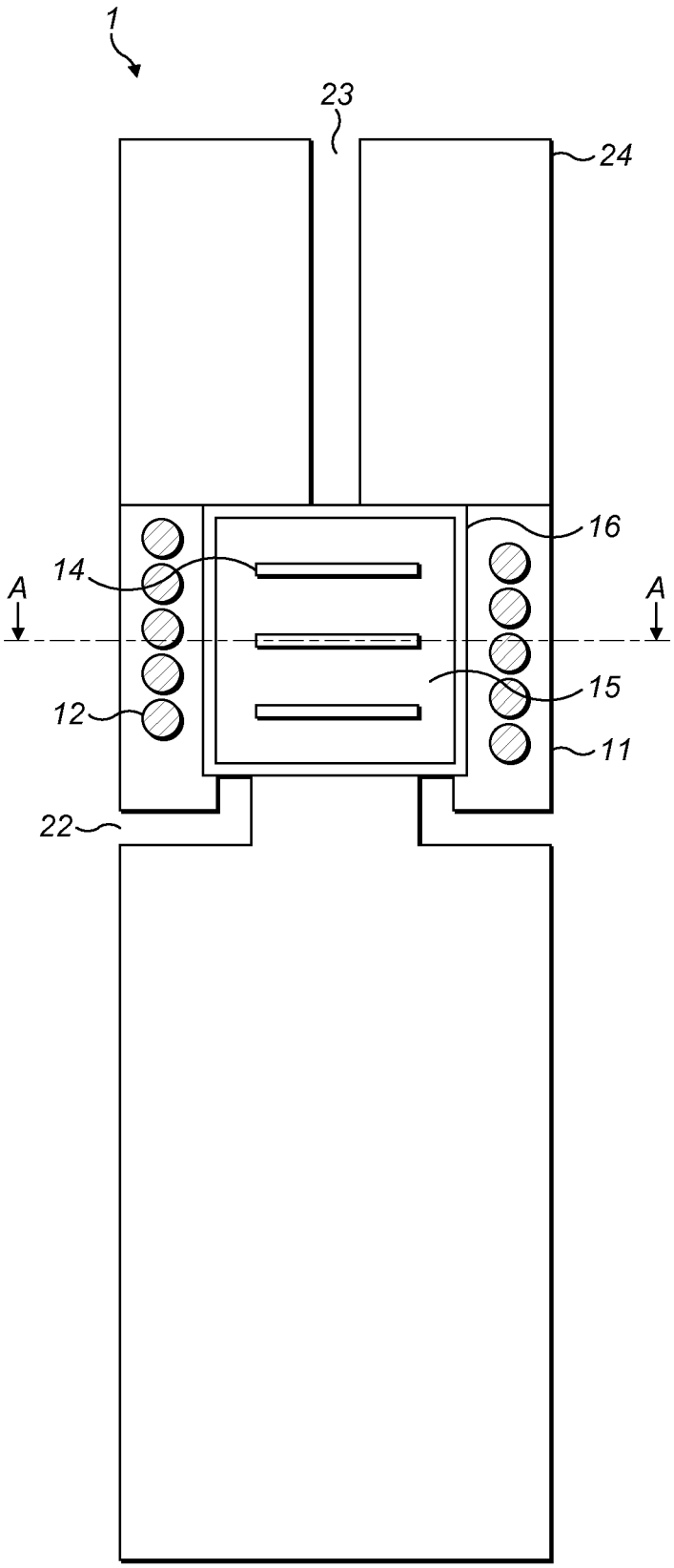
FIG. 1 schematically illustrates a vapour generating device according to an example of the present invention.
Figure 2:
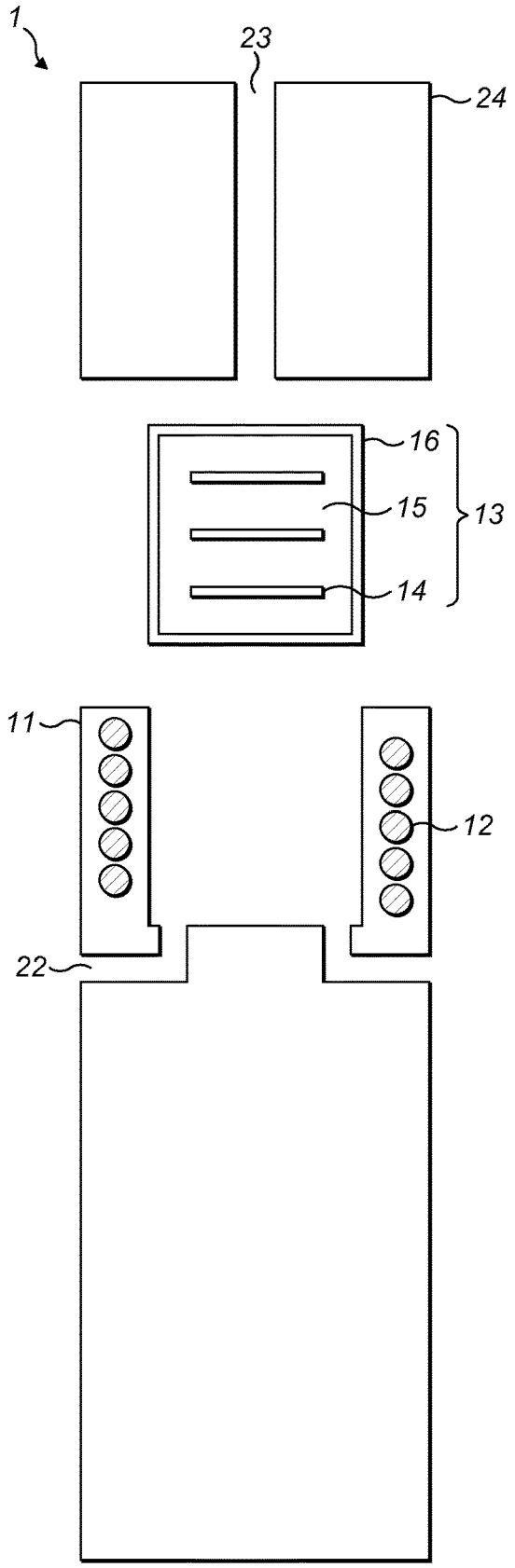
FIG. 2 schematically illustrates an exploded view of the vapour generating device according to FIG. 1.

FIGS. 1 and 2 schematically illustrate a vapour generating device according to an example of the present invention. The example device is generally illustrated at 1 in an assembled configuration in FIG. 1 and an unassembled configuration in FIG. 2.

The example vapour generating device 1 is a hand held device (by which we intend to mean a device that a user is able to hold and support un-aided in a single hand) and comprises an induction heatable cartridge 13 and an induction heating circuit 12. Vapour is released by the cartridge 13 when it is heated. In use, vapour is generated by using the induction heating assembly 11 to heat the induction heatable cartridge 13. The vapour is then able to be inhaled by a user.

An air inlet 22 positioned adjacent to the induction heatable cartridge 13 provides air from the surrounding environment to the cartridge 13. An air outlet 23 is in gaseous communication with the cartridge 13 and provides the ability to extract vapour produced from the cartridge 13 in use. In this example, the device 1 further comprises a mouthpiece 24 in communication with the air outlet 23. The mouthpiece 24 provides the user with the ability to easily draw the vapour generated from the device 1. In use, a user inhales the vapour by drawing the air into the device 1, through or around the induction heatable cartridge 13 and out of the mouthpiece 24 when the cartridge 13 is heated. Air is drawn through the device 1 by the application of negative pressure, which is usually created by a user drawing air from the air outlet 23.

The cartridge 13 is a body which includes a vaporisable substance 15 and an induction heatable susceptor arrangement 14. In this example, the vaporisable substance 15 includes one or more of tobacco, humectant, glycerine and propylene glycol. The susceptor arrangement 14 comprises a plurality of plates 14 that are electrically conducting. In this example, the cartridge 13 also has an air permeable layer or membrane 16 to contain the vaporisable substance 15 and susceptors 14. In other examples the membrane 16 is not present.

As noted above, the induction heating assembly 11 is used to heat the cartridge 13. The assembly 11 includes an induction heating device, in the form of an induction circuit 12 and a power source (not shown in the figures). The power source and induction circuit 12 are electrically connected such that electrical power may be transmitted between the two components.

Figure 3:
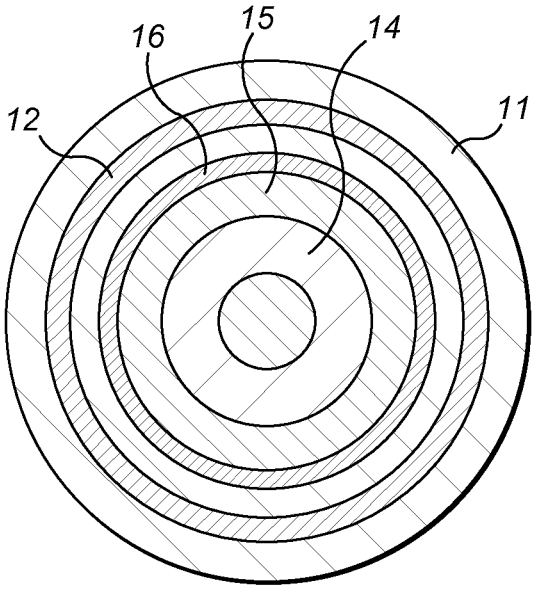
FIG. 3 shows a schematic cross-sectional view through a portion of the vapour generating device according to FIGS. 1 and 2.

In this example, the induction circuit 12 and the cartridge 13 are both substantially cylindrical. A top-down cross sectional view of the device 1 through line A-A is schematically illustrated in FIG. 3. The cross section includes regions of the induction heating circuit 12 and the induction heatable cartridge 13 which is held within the induction circuit 12.

Starting with the outermost portion of the cross-section, the induction heating circuit 12 includes an annular housing for the induction circuit which has a circular cross section. The induction heatable cartridge 13 is held in place within the inner region of the annular housing. In this example, the region of the cartridge 13 is defined by an air permeable shell 16 (or membrane) which also has a circular cross section. The shell 16 contains a vaporisable substance 15 and ring-shaped induction heatable susceptors 14 held within and surrounded by the vaporisable substance 15. Each of the ring-shaped susceptors 14 is itself a closed circuit and is arranged such that its centre aligns substantially with the centre of the induction heating circuit 12. The susceptors 14 are in contact with the vaporisable substance 15 which surrounds the susceptors 14 from all sides.

In use, the application of an electromagnetic field from the induction circuit 12 causes the susceptors 14 to heat up. Vapour is generated by the heat from the susceptors 14 vaporising the surrounding vaporisable substance 15.

As the susceptors 14 are heated by induction heating, which requires the transmission of power through an electromagnetic field, in most situations the heating effect is increased when the distance between a susceptor 14 and the induction circuit 12 is reduced.

Figure 4:
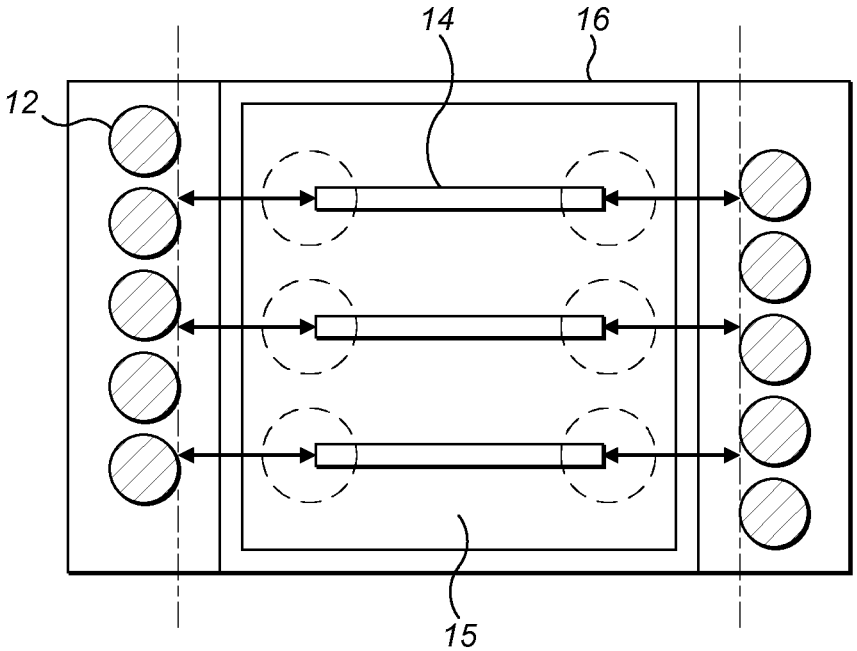
FIG. 4 schematically illustrates an induction heatable cartridge held within an induction circuit according to an example of the present invention.

The distance between the outer edge of a susceptor 14 and the induction circuit 12 is depicted in FIG. 4 which schematically illustrates a close-up view of an example induction heatable cartridge 13 held within a portion of the induction circuit 12.

In this example, the distance between an outer edge of a susceptor and the induction circuit (distance A in FIG. 4) is defined as the shortest radial distance between the outer edge of the susceptor and the inner perimeter of the induction circuit 12. An outer edge of the susceptor 14 is defined as the region of the susceptor 14 in the immediate vicinity of a point on the circumference of the susceptor 14. This distance defines the extent of heat generated at the outer edge of the susceptor 14. As noted above, a smaller distance leads to a greater heat generation at the edge of that susceptor 14 due to the fact that the electromagnetic coupling is improved at shorter distances.

The distance between the (outer and or inner) edges of the susceptors 14 and the induction circuit 12 can be varied to control the heat generated at each edge. In other words, the heat profile produced from the edges of the susceptors 14 can be chosen by setting their distance from the induction circuit 12 accordingly. Using a plurality of ring-shaped susceptors 14, as shown in FIG. 4, having different such distances (not explicitly illustrated in FIGS. 1 to 4), it is possible to precisely generate a desired heat profile within the induction heatable capsule 13 with the application of a substantially uniform induction field. As a result, a relatively complex phenomenon can be produced with a simple dimensional design arrangement within the consumable.

We now describe example arrangements of the cartridge and induction circuit with reference to the figures. Although the examples depicted include three susceptors, this is for the purposes of illustrating the characteristics of each arrangement. In other examples, the cartridge may comprise any number of susceptors.

Figure 5A:
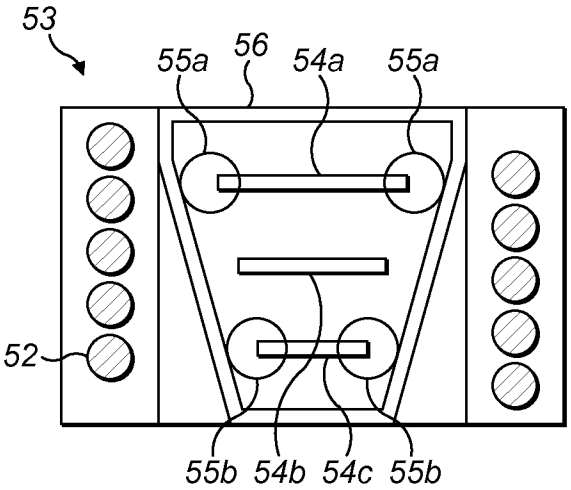
FIGS. 5A to 5D schematically illustrate examples, according to the present invention, of an induction heatable cartridge held within an induction circuit.

FIG. 5A schematically illustrates an example cartridge 53 held within an induction circuit 52. The cartridge 53 is substantially cylindrical and has a base side at an axial end of the cartridge, a top side at an opposing axial end of the cartridge and a circumferential side. The cartridge 53 comprises a frusto-conical body of vaporisable substance 55 which tapers towards the base side of the cartridge 53. Three ring-shaped susceptors 54 are held within and surrounded by the vaporisable substance 55. The susceptors 54 are arranged such that the centres of each of the susceptors 54 are substantially aligned with the central longitudinal axis of the induction circuit 52.

Starting from the susceptor closest to the top side of the cartridge 53, the uppermost ring-shaped susceptor 54*a* has a first diameter, the middle ring-shaped susceptor 54*b* has a second diameter smaller than the first diameter and the lowermost ring-shaped susceptor 54*c* has a third diameter smaller than the second and first diameters.

An air permeable shell 56 substantially surrounds the vaporisable substance 55. The shell 56 provides structural support to hold the vaporisable substance 55 while allowing air and vapour to pass through by diffusion.

The induction circuit 52 substantially surrounds the circumferential side of the cartridge 53. The internal form of the housing for the induction circuit has a complementary shape relative to the shape of the induction cartridge 53. This allows the cartridge 53 to be inserted and held in place by the induction device 51. As the susceptors 54 have different diameters, their outer edges are at different distances from the surrounding induction circuit 52. For example, the uppermost susceptor 54*a*, which has the largest diameter, has its outer edge at the shortest distance from the induction circuit 52.

In this example, the outer edge of the uppermost susceptor 54*a* is at least locally surrounded by a first type of vaporisable substance 55*a* which is suitable for being heated at a first temperature. The outer edge of the lowermost susceptor 54*c* is at least locally surrounded by a second type of vaporisable substance 55*b* which is suitable for being heated at a second temperature which is lower than the first temperature.

In use, the application of an electromagnetic field from the induction circuit 52 causes each susceptor 54 to generate heat. As noted above, the smaller the distance between the induction circuit 52 and the outer edge of the susceptor 54, the larger the amount of heat generated at that edge. While the induction circuit 52 generates a substantially uniform electromagnetic field along its longitudinal axis, the heat generated at the outer regions of each susceptor 54 differs such that the heating effect is non-uniform along a longitudinal axis of the cartridge 53. As a result, different regions of the cartridge 53 are heated to different temperatures with only the need to apply a single electromagnetic field from the induction circuit 52.

With the induction circuit 52 switched on, a vapour of the first vaporisable substance 55*a* is generated at the outer edge of the uppermost susceptor 54*a*, and a vapour of the second vaporisable substance 55*b* is generated at the outer edge of the lowermost susceptor 54*c*. In this way the cartridge 53 provides the ability to generate a vapour mixture from two different vaporisable substances at the same time with the use of a single induction circuit 52.

Figure 5B:
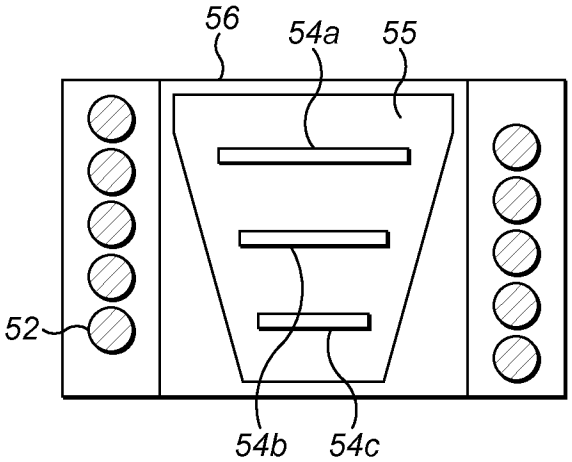

Whilst the air permeable shell 56 maintains the frusto-conical shape of the vaporisable substance 55, the cartridge 53 is cylindrical in shape. In another example, as illustrated in FIG. 5B, the air permeable shell 56 is substantially cylindrical in external form and has an internal taper to complement the frusto-conical volume of the vaporisable substance 55. This allows air drawn in from the air inlet 22 to be distributed across the full surface of the vaporisable substance 55 to increase ventilation and supply of air for vaporisation.

Figure 5C:
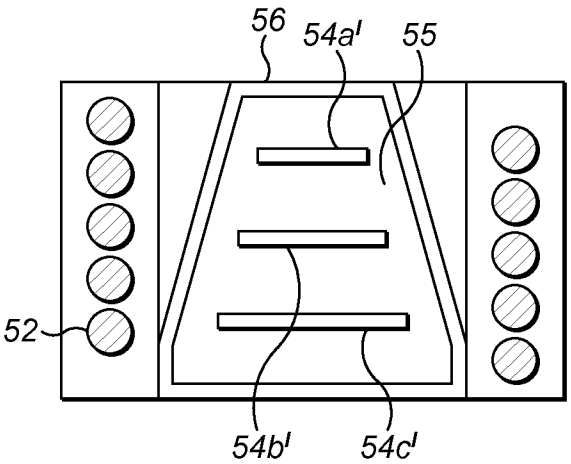

Another example of an induction heatable cartridge, schematically illustrated in FIG. 5C, is similar to the cartridge described above in reference to FIG. 5A. In this example, the frustro-conical body of vaporisable substance 55 instead tapers towards the top side of the cartridge 53 and the three ring-shaped susceptors 54' progressively increase in diameter from the uppermost susceptor 54*a'* to the lowermost susceptor 54*c'*. As a result, more heat is generated in use at the outer edge of the lowermost susceptor 54*c'*.

Figure 5D:
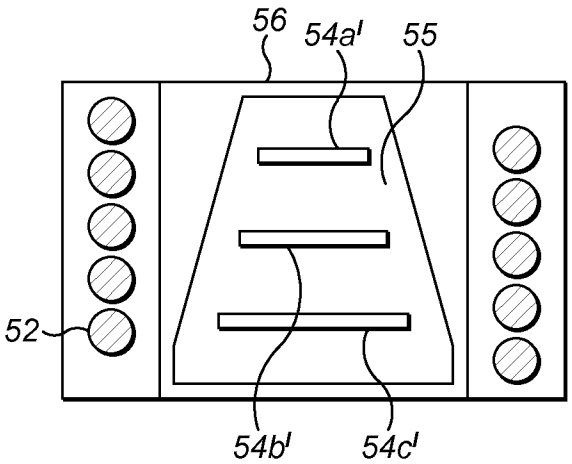

In another example, as illustrated in FIG. 5D, the air permeable shell 56 is substantially cylindrical in external form and has an internal taper to complement the frusto-conical volume of the vaporisable substance 55. As above, this increases ventilation and air supply to the vaporisable substance.

Figure 6B:
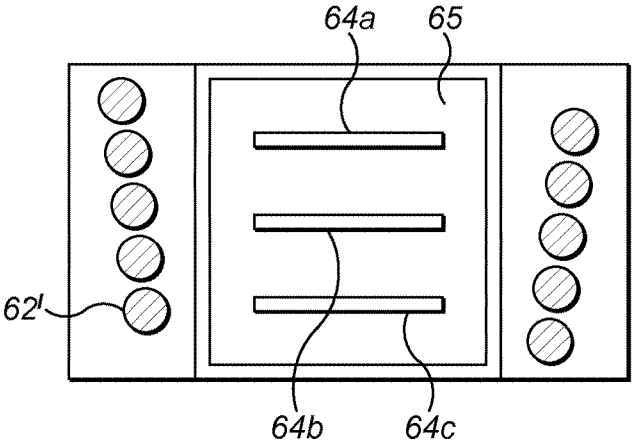
FIGS. 6A, 6B, 7 and 8 schematically illustrate further examples, according to the present invention, of an induction heatable cartridge held within an induction circuit.
Figure 6A:
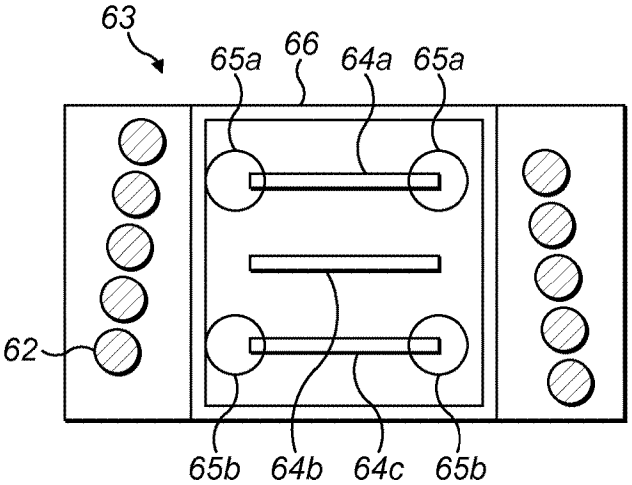

FIG. 6A schematically illustrates an example cartridge 63 held within an induction circuit 62. The cartridge is cylindrical and has a base side at an axial end of the cartridge 63, a top side at an opposing axial end of the cartridge 63 and a circumferential side. The cartridge 63 comprises a cylindrical body of vaporisable substance 65. Three ring-shaped susceptors 64 are held within and surrounded by the vaporisable substance 65. The susceptors 64 are arranged such that the centres of each of the susceptors 64 are aligned with the central longitudinal axis of the cartridge 63. In this example, the susceptors 64 have substantially the same diameter.

An air permeable shell 66 substantially surrounds the vaporisable substance 65. The shell 66 provides structural support to hold the vaporisable substance 65 while allowing air and vapour to pass through by diffusion.

The induction circuit 62 substantially surrounds the circumferential side of the cartridge 63. In this example, the induction circuit 62 is a coil wound with increasing radial diameter from the upper axial end to the lower axial end, such that the coil 62 is substantially frusto-conical in form. In this arrangement, although the susceptors 64 all have substantially the same diameter, the distance between the outer edges of each susceptor 64 and the induction circuit 62 progressively increases from the uppermost susceptor 64*a* to the lowermost susceptor 64*c*.

Due to the differences in distance, in use, the induction circuit 62 generates an electromagnetic field which is not uniform along its longitudinal axis. Accordingly, the most heat is generated at the outer edge of the uppermost susceptor 64*a*, while the lowermost susceptor 64*c* generates less heat at its outer edge.

As above, this difference in heat generated can be exploited by using two or more different types of vaporisable substance 65. In this example, the outer edge of the uppermost susceptor 64*a* is at least locally surrounded by a first type of vaporisable substance 65*a* which is suitable for being heated at a first temperature. The outer edge of the lowermost susceptor 64*c* is at least locally surrounded by a second type of vaporisable substance 65*b* which is suitable for being heated at a second temperature which is lower than the first temperature.

With the induction circuit switched on, a vapour of the first vaporisable substance 65*a* is generated at the outer edge of the uppermost susceptor 64*a*, and a vapour of the second vaporisable substance 65*b* is generated at the outer edge of the lowermost susceptor 64*c*. In this way the cartridge 63 provides the ability to generate a vapour mixture from two different vaporisable substances at the same time with the use of a single induction circuit 62.

Another example of an induction heatable cartridge, schematically illustrated in FIG. 6B, is similar to the cartridge described above in reference to FIG. 6A. In this example, the induction coil 62' is wound with decreasing diameter from the upper axial end to the lower axial end, such that the coil 62' is substantially frusto-conical in form with the taper towards the base side. In this arrangement, more heat is generated in use at the outer edge of the lowermost susceptor 64*c*.

Figure 7:
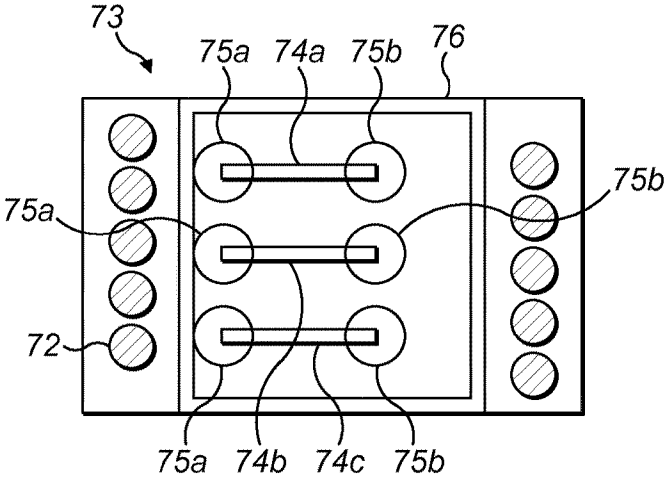

FIG. 7 illustrates another example cartridge 73 held within an induction circuit 72. The cartridge 73 is cylindrical and has a base side at an axial end of the cartridge 73, a top side at an opposing axial end of the cartridge 73 and a circumferential side. The cartridge 73 comprises a cylindrical body of vaporisable substance 75. Three ring-shaped susceptors 74 are held within and surrounded by the vaporisable substance 75. The susceptors 74 are arranged such that the centres of each of the susceptors 74 are aligned along a longitudinal axis of the cartridge 73. The longitudinal axis is offset from the central axis of the induction circuit 72. In this example, the susceptors 74 have substantially the same diameter.

As each susceptor 74 is substantially aligned along an off-centre axis of the induction circuit 72, different regions of their outer edges are at different distances from the induction circuit 72. For example, in the cross-section depicted in FIG. 7, the susceptors 74 are aligned closer to the left hand side of the induction circuit 72. In this arrangement, the leftmost outer edges of the susceptors 74 are closer to the induction circuit 72 than the rightmost outer edges, and as a result the heat generated in use at the leftmost outer edges is greater than the heat generated at the rightmost outer edges.

As above, this difference in heat generated can be exploited by using two or more different types of vaporisable substance. In this example, the leftmost outer edges of the susceptors 74 are locally surrounded by a first type of vaporisable substance 75*a* which is suitable for being heated at a first temperature. The rightmost outer edges of the susceptors 74 are locally surrounded by a second type of vaporisable substance 75*b* which is suitable for being heated at a second temperature which is lower than the first temperature.

With the induction circuit 72 switched on, a vapour of the first vaporisable substance 75*a* is generated at the leftmost outer edges of each susceptor 74, and a vapour of the second vaporisable substance 75*b* is generated at the rightmost outer edges of each susceptor 74. In this way the cartridge 73 provides the ability to generate a vapour mixture from two different vaporisable substances at the same time with the use of a single induction circuit 72.

Figure 8:
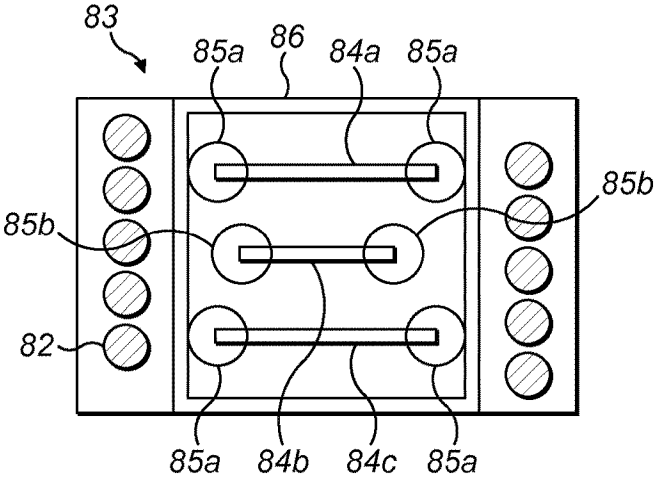

FIG. 8 illustrates another example cartridge 83 held within an induction circuit 82. The cartridge 83 is cylindrical and has a base side at an axial end of the cartridge 83, a top side at an opposing axial end of the cartridge 83 and a circumferential side. The cartridge 83 comprises a cylindrical body of vaporisable substance 85. Three ring-shaped susceptors 84 are held within and surrounded by the vaporisable substance 85. The susceptors 84 are arranged such that the centres of each of the susceptors 84 are aligned along a longitudinal axis of the cartridge 83. In this example, the uppermost 84*a* and lowermost 84*c* susceptors both have a first diameter, while the middle susceptor 84*b* has a second diameter smaller than the first diameter.

In this arrangement, the uppermost 84*a* and lowermost 84*c* susceptors have their outer edges at a first distance from the induction circuit 82, while the middle susceptor 84*b* has its outer edge at a second distance from the induction circuit 82, larger than the first distance.

In use, the heat generated at the outer edges of the uppermost 84*a* and lowermost 84*c* susceptors is greater than the heat generated at the outer edge of the middle susceptor 84*b*. As above, this difference in heat generated can be exploited by using two or more different types of vaporisable substance 85. In this example, the outer edges of the uppermost 84*a* and lowermost 84*c* susceptors are locally surrounded by a first type of vaporisable substance 85*a* which is suitable for being heated at a first temperature and the outer edge of the middle susceptor 84*b* is locally surrounded by a second type of vaporisable substance 85*b* which is suitable for being heated at a second temperature lower than the first temperature.

With the induction circuit 82 switched on, a vapour of the first vaporisable substance 85*a* is generated at the outer edges of the uppermost 84*a* and lowermost 84*c* susceptors, and a vapour of the second vaporisable substance 85*b* is generated at the outer edge of the middle susceptor 84*b*. In this way the cartridge 83 provides the ability to generate a vapour mixture from two different vaporisable substances at the same time with the use of a single induction circuit 82.

Although in this example the susceptors 84 are aligned along a central longitudinal axis of the induction circuit 82, in other examples the susceptors 84 are aligned along an off-centre longitudinal axis of the induction circuit 82.

As will be appreciated from the above, the present invention, by placing at least two ring-shaped induction heatable susceptor with different regions of the outer edge at different distances from the induction circuit, enables the provision of a vapour generating device which is capable of producing a complex vapour generated from a plurality of vaporisable substances. Furthermore, by changing the arrangement, dimension, or alignment of the susceptors within a consumable, it is possible to provide different user experiences for different types of consumable when used with a common device. An electronic vapour generating device with a safe heating mechanism to produce a desired heat profile is achieved by the invention and yet maintains the compactness and portability of such a vapour generating device.

The invention claimed is:

1. An induction heatable cartridge arranged, in use, to be inserted to a chamber of an induction heating assembly, the chamber being at least partially surrounded by an induction circuit, the cartridge comprising:

a solid vaporisable substance; and at least two ring-shaped induction heatable susceptors held within and surrounded by the vaporisable substance, the at least two susceptors held in position such that, when the cartridge is at least partially surrounded by the induction circuit in use, different regions of edges of the at least two susceptors are at different distances from the induction circuit to provide different heating characteristics in the different regions, and wherein centres of each of the at least two susceptors are aligned along a common axis.

2. The cartridge according to claim 1, wherein each of the at least two susceptors has a different shape or size to each other.

3. The cartridge according to claim 1, wherein each of the at least two susceptors is substantially circular and has a different diameter to each other.

4. The cartridge according to claim 1, wherein the common axis is a longitudinal axis of the cartridge.

5. The cartridge according to claim 4, wherein the common axis is a central longitudinal axis of the cartridge.

6. The cartridge according to claim 1, wherein an axis of alignment of the at least two susceptors is arranged such that when the cartridge is placed within an induction circuit in use the axis of alignment is parallel with an axis of the induction circuit.

7. The cartridge according to claim 1, wherein a diameter of each of the at least two susceptors is smaller than its predecessor in a given direction to provide an array of the at least two susceptors of progressively smaller diameter.

8. The cartridge according to claim 1, wherein different solid vaporisable substances are positioned around each of the different regions.

9. The cartridge according to claim 8, wherein a first material of the different solid vaporisable substances releases vapour of a first predetermined temperature and a second material of the different solid vaporisable substances releases vapour of a second temperature higher than the first temperature.

10. The cartridge according to claim 1, wherein the solid vaporisable substance comprises tobacco.

11. A vapour generating device comprising:

the induction heatable cartridge according to claim 1; and an induction heating circuit arranged to generate, in use, an electromagnetic field which couples with the cartridge to create heat therein.

12. The vapour generating device according to claim 11, wherein the induction circuit is in the form of a cylindrical coil.

13. The vapour generating device according to claim 11, wherein the induction circuit is in the form of a coil having a longitudinally varying diameter, such that the circuit has components which are at different lateral distances from the at least two susceptors in the cartridge to provide different heating characteristics in the different regions of the cartridge.

14. The vapour generating device according to claim 11, wherein the induction circuit has a form in which an internal diameter thereof progressively decreases in an axial direction.

15. A vapour generating device comprising:

an induction heatable cartridge having one or more susceptors, the one or more susceptors each having a diameter that is substantially the same; and an induction heating circuit arranged to generate, in use, an electromagnetic field which couples with the cartridge to create heat therein; wherein the induction circuit is in the form of a coil having a longitudinally varying diameter, such that the circuit has components which are at different lateral distances from outer edges of the one or more susceptors in the cartridge to provide different heating characteristics in different regions of the cartridge.

16. The vapour generating device according to claim 15, wherein a variation in diameter of the coil is non-continuous along a longitudinal axis of the coil.

* * * * *